United States Patent [19]

Caporali et al.

[11] Patent Number: 4,924,205

[45] Date of Patent: May 8, 1990

[54] CHIP RESISTOR AND METHOD OF MANUFACTURING A CHIP RESISTOR

[75] Inventors: Didier Y. F. Caporali; Frans L. A. Geernickx, both of Brussels, Belgium

[73] Assignee: U.S. Philips Corporation, New York, N.Y.

[21] Appl. No.: 295,717

[22] Filed: Jan. 10, 1989

[30] Foreign Application Priority Data

Jan. 25, 1988 [NL] Netherlands ..... 8800156

[51] Int. Cl.[5] ..... H01C 1/02

[52] U.S. Cl. ..... 338/227; 29/610.1; 338/314; 338/327; 338/203

[58] Field of Search ..... 338/327, 333, 334, 203, 338/305, 314, 20, 21, 22, 25; 29/621, 610.1

[56] References Cited

U.S. PATENT DOCUMENTS

| | | | |
|---|---|---|---|
| 2,253,360 | 8/1941 | Berkey | 338/21 X |
| 2,253,376 | 8/1941 | Johnson | 338/21 |
| 4,706,060 | 11/1987 | May | 338/20 |
| 4,786,888 | 11/1988 | Yoneda et al. | 338/22 R |

*Primary Examiner*—C. L. Albritton

*Attorney, Agent, or Firm*—Norman N. Spain

[57] ABSTRACT

A chip resistor comprising a cuboid resistor body of a ceramic material and solderable, metal, current-supply strips at a first pair of opposing side faces of the resistor body, can readily and accurately be manufactured in that a second pair of opposing side faces of the resistor body is covered completely with electrically insulating layers and in that the metal strips around the edges of the resistor body in such a way that the electrically insulating layers are partly covered by the metal strips.

4 Claims, 2 Drawing Sheets

CHIP RESISTOR AND METHOD OF MANUFACTURING A CHIP RESISTOR

BACKGROUND OF THE INVENTION

The invention relates to a chip resistor comprising a cuboid resistor body of ceramic material and solderable, metal, current-supply strips at a first pair of opposite side faces of the resistor body.

The invention also relates to a method of manufacturing such a chip resistor.

The invention can particularly suitably be applied to reistors having no lead wires, a semiconductive ceramic material being used as a resistance material, in particular materials having a negative (NTC) or a high positive (PTC) temperature coefficient of electrical resistance.

U.S. Pat. No. 3,027,529 describes a PTC resistor, in which a resistor body in the form of a cylinder or a disc is used. The electric connections consist of metal caps which are fitted around the ends of the cylinder, or of lead wires which are soldered to the flat sides of the disc.

In the manufacture of electric components having no lead wires, the dimensions of which should be as small as possible, and which should be manufactured at low costs, the application of caps is undesired in many cases. According to an alternative method, contact faces for the supply of electric current are manufactured by means of sputtering, metal spraying or vapour deposition, but it is not easy to manufacture contact faces which extend around the edges of the component by such methods.

Components having no lead wires, which are preferably cuboid, should at each end be provided with terminals on three faces owing to the various soldering techniques used for mounting on a printed circuit board. In the case of wave-soldering, a component is temporarily fixed to a printed circuit board by means of an adhesive, after which a solder wave is led over the surface of the board. This technique requires the presence of terminals at the side faces of the electric component. In a vapour soldering process, drops of a solder paste are placed on the printed circuit board, after which the electric components are provided and the assembly is heated in a vapour, the solder paste being converted into a conductive contact material. This technique requires the presence of terminals on the lower side of the electric component which lies against the printed circuit board. For reasons of symmetry there is preferably also a terminal on the upper side, so as to render an additional check superfluous when the electric component is mounted on the printed circuit board.

Electric contact faces extending around the edges of a component can be manufactured in known manner in an immersion process, for example by means of an electroless metallizing bath followed by electrodeposition, or by means of a metal paste. In an emerging process which is applied to a resistor body which consists completely of resistance material, there is the problem that the immersion depth, and, hence, the resistance value is hard to control accurately. Unlike a thin-film resistor, the proper resistance value cannot simply be obtained by trimming, for example, using a laser. On the other hand, the use of resistors which consist predominantly of resistance material is important, for example, for the manufacture of accurate resistors having a low resistance value, for applications involving a high electric power rating and for the manufacture of NTC and PTC resistors from semiconductive ceramic material.

SUMMARY OF THE INVENTION

It is an object of the invention to provide a resistor of small dimensions and having no lead wires, in which the resistance value is controlled within narrow tolerances, and which resistor can suitably be used in all common soldering processes for mounting on a printed circuit board, and which can readily be manufactured in large numbers and at a high yield.

This object is achieved according to the invention by a chip resistor as described in the opening paragraph, which the chip resistor is characterized in that a second pair of opposing side faces of the resistor body is covered completely with electrically insulating layers, and in that the metal strips are provided around the edges of the resistor body in such a way that the electrically insulating layers are partly covered by the metal strips.

The electrically insulating layer may consist of, for example, a glass composition or a synthetic resin. In a preferred embodiment of the chip resistor according to the invention, the electrically insulating layers are made of a ceramic material.

The object of providing a readily conceivable and efficacious method of manufacturing a chip resistor is achieved according to the invention by a method which comprises the following steps:

- a plate of a ceramic resistance material is provided on both sides with electrically insulating layers,
- the plate is divided into strips,
- by means of an immension process, solderable metal strips are provided on the large, uninsulated sides of the strips,
- the strips are divided into cuboids.

Dividing the plate into strips and the strips into cuboids can for example be carried out by sawing or by scribbing and breaking. Scribbing can be carried out mechanically or by means of a laser. These methods can also be combined at will, for example, sawing the plate into strips and breaking the strips into cuboids. If breaking is applied, lines of feature are provided on the surface of the plate, preferably, after the electrically insulating layers have been applied.

In U.S. Pat. No. 4,529,960 a description is given of a chip resistor comprising a thin resistance layer on a substrate. Metal layers are provided on two opposing edges of the resistance layer. Metal strips are provided on the side faces of the substrate, which strips extend around the edges in order to contact the metal layers and which can suitably be soldered at several sides. The metal strips are provided by electrodeposition, but the accuracy observed in the immersion process does not influence the resistance value because, in this case, the metal strips contact a metal layer and are not in direct contact with the resistance layer.

In German Patent Application DE-A-3148778, a description is given of a chip resistor, in which metal faces are provided on a ceramic substrate, on top of which a resistance layer is applied. By means of immersion, contact layers may be applied around the edges of the substrate but the immersion depth is not critical for the resistance value obtained. Sometimes, a protective layer is provided on top of the resistance layer, but this protective layer does not have a function as regards the determination of the resistance value.

According to both the United States and the German Patent Specifications, the chip resistors are manufactured from a nonconductive ceramic plate which is divided into strips which are then divided into cuboids.

The invention will now be explained by means of an example and with reference to the drawing.

BRIEF DESCRIPTION OF THE DRAWING

In drawing

DETAILED DESCRIPTION OF THE INVENTION

Example

Figure 1A:
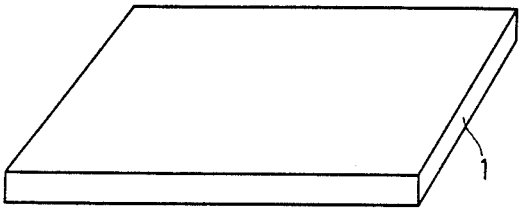
FIGS. 1*a*–1*e* are front views and FIGS. 2*a*–2*d* are sectional, schematic views of a number of intermediate products formed during a number of steps of the method of the inventor.
Figure 2A:
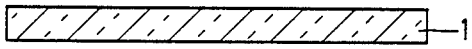

According to the example, a ceramic plate 1 of a NTC resistance material is used, see FIGS. 1*a*, 2*a*. The thickness of the plate corresponds to the thickness of the chip resistor to be manufactured and amounts to, for example, 0.5 to 0.8 mm.

Figure 1B:
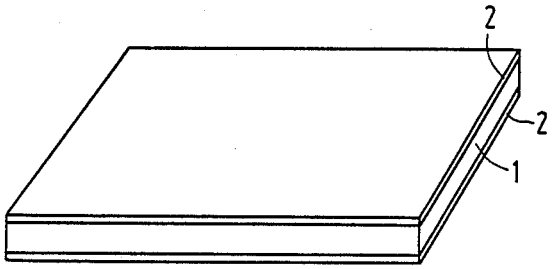
Figure 2B:
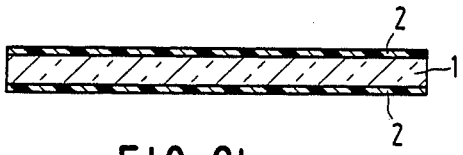

The ceramic plate is immersed completely in a zirconium oxide paste which contains 425 g of $ZrO_2$ per $dm^3$ of water. Subsequently, the plate is dried in air at 125° C. for 30 m. Subsequently, while enamel layers 2 are formed on both surfaces of the ceramic plate, by firing in air at 900° C. for 1 hour, see FIGS. 1*b*, 2*b*.

Figure 1C:
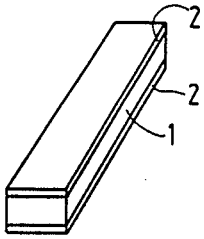
Figure 2C:
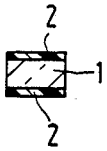

The ceramic plate is sawn into strips, the width of the strips corresponding to the length of the chip resistor to be manufactured, see FIGS. 1*c*, 2*c*. The width of the strips amounts to, for example, 0.6 to 2.0 mm.

Figure 1D:
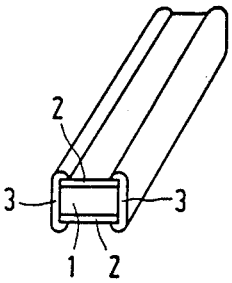
Figure 2D:
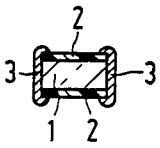

Subsequently, metal strips 3 are provided by immersing into a metal paste, for example a silver palladium paste consisting of a mixture of finely dispersed Ag and Pd (weight ratio 60/40) in a binder of cellulose acetate. The metal paste is fired, thereby forming the conductive metal strips, see FIGS. 1*d*, 2*d*.

Figure 1E:
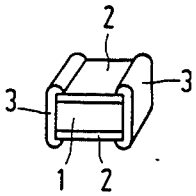

Finally, the strips are sawn into cuboids, see FIG. 1*e*, the width of the chip resistor formed co-determining the resistance value attained and amounting to, for example, 0.6 to 1.2 mm. If desired, the chip resistor obtained can be provided with, for example, a protective coating of, for example, a synthetic resin.

The method described herein permits accurate resistors to be manufactured, with both high and low resistance values being possible.

What is claimed is:

1. A chip resistor comprising of cuboid ceramic resistor body, electrically insulating layers completely covering a first pair of opposing side faces of said resistor body, and metal current-supply strips provided on a second pair of opposing side faces of said resistor body and extending over the edges of said first pair of opposing side faces covered with layers of said electrically insulating layers so as to partially cover said electrically insulating layers.

2. A method of manufacturing a chip resistor in which a cuboid resistor body is provided on two opposing side faces with metal current-supply strips, said method comprising the steps:

(a) providing both surfaces of a plate of a ceramic resistance body with electrically insulating layers, (b) dividing said plate into first strips, (c) immersing said strips into a composition capable of providing solderable metal strips on said first strips in a manner such that said metal strips are provided on the large uninsulated sides of the strips while extending over the edges of said electrically insulating layers so as to partially cover said electrically insulating layers, and (d) dividing said strips, provided with the solderable metal layers, into cuboids.

3. A chip resistor as claimed in claim 1, wherein the electrically insulating layers are made of a ceramic material.

4. A method as claimed in claim 2, wherein lines of fracture are provided on the surface of the plate after the electrically insulating layers have been applied.

* * * * *